US005582541A

United States Patent [19]

Hutchins

[11] Patent Number: 5,582,541

[45] Date of Patent: Dec. 10, 1996

[54] ABRADING TOOL WITH WATER FEED AND REMOVAL SYSTEM

[75] Inventor: Donald H. Hutchins, Sierra Madre, Calif.

[73] Assignee: Hutchins Manufacturing Company, Pasadena, Calif.

[21] Appl. No.: 518,753

[22] Filed: Aug. 24, 1995

[51] Int. Cl.[6] ..... B24B 23/00

[52] U.S. Cl. ..... 451/357; 451/344

[58] Field of Search ..... 451/357, 344, 451/353, 270

[56] References Cited

U.S. PATENT DOCUMENTS

| | | | |
|---|---|---|---|
| 3,110,993 | 11/1963 | Grage . | |
| 3,785,092 | 1/1974 | Hutchins | 51/170 MT |
| 4,022,182 | 5/1977 | Lenkevich | 125/13 R |
| 4,102,084 | 7/1978 | Bloomquist | 51/170 MT |
| 4,129,966 | 12/1978 | Smart et al. | 51/170 T |
| 4,398,375 | 8/1983 | Malyuk | 451/357 |
| 4,490,948 | 1/1985 | Hanstein et al. . | |
| 4,592,170 | 6/1986 | Hutchins et al. | 451/357 |
| 4,671,020 | 6/1987 | Hutchins | 451/357 |
| 4,671,096 | 6/1987 | Hutchins | 51/170 MT |
| 5,022,190 | 6/1991 | Hutchins | 51/170 |
| 5,261,190 | 11/1993 | Berger et al. | 451/357 |
| 5,319,888 | 6/1994 | Huber et al. | 451/357 |
| 5,445,558 | 8/1995 | Hutchins | 451/357 |
| 5,458,533 | 10/1995 | Barth et al. | 451/357 |

FOREIGN PATENT DOCUMENTS

| | | | |
|---|---|---|---|
| 58-59765A | 4/1983 | Japan | 51/267 |

OTHER PUBLICATIONS pp. 24 and 25 of Feb. 1994 issue of Chilton's Automotive Body Repair New.

Leaflet entitled KOVAX Orbital Sander Part No. 910–8735.

*Primary Examiner*—Bruce M. Kisliuk
*Assistant Examiner*—Andrew Weinberg
*Attorney, Agent, or Firm*—William P. Green

[57] ABSTRACT

A portable abrading tool including a tool body and a head which is movable relative to the tool body by a motor and is adapted to carry a sheet of sandpaper or other element for abrading or polishing a work surface, with the head containing a first passage or passages for conducting a flow of incoming water through the interior of the head to the work surface, and an additional passage or passages for conducting a suction induced flow of intermixed air, water and abraded particles from the work surface through the interior of the head in isolation from the incoming water and without flow of the intermixed air, water and particles through the first passage or passages. The abrading head is preferably driven orbitally by the motor, and desirably includes a deformable cushion within which the two types of passages are formed in isolation from one another, and with the head having a backing plate at the upper side of the deformable cushion which may contain openings through which water flows into the head and the intermixed air, water and particles leave the head.

20 Claims, 4 Drawing Sheets

ABRADING TOOL WITH WATER FEED AND REMOVAL SYSTEM

This invention relates to portable power driven tools for abrading or polishing a work surface.

BACKGROUND OF THE INVENTION

In sanding a work surface with a portable power driven sanding tool, it is frequently desirable to deliver a flow of water to the work surface during the sanding operation, to act as a lubricant and coolant and wash away particles abraded from that surface. U.S. Pat. No. 5,022,190 issued Jun. 11, 1991 to Alma A. Hutchins shows a sander in which the water is fed to the work surface through passages in an orbitally driven head of the tool which carries a sheet of sandpaper. In my U.S. patent application Ser. No. 8/277,758 filed Jul. 20, 1994 on "Wet Sander", I have shown a sanding tool also having a head containing passages through which water is delivered to the work surface, and having a shroud disposed about the sanding head and within which a reduced pressure is created to withdraw air, water and particles from the work surface by suction as the work progresses.

SUMMARY OF THE INVENTION

The present invention provides a different type of arrangement for both delivering water to and removing intermixed air, water and particles-from a work surface during an abrading operation, in a manner having advantages for some types of operations over the prior tools of my above identified application. For one thing, a tool embodying this invention can both deliver water to and remove the intermixed air, water and particles from the work surface without the necessity for provision of an enveloping shroud about the abrading head. A tool constructed in accordance with the invention can be structurally very simple, easy to manipulate and control, and reliable in operation.

To achieve these results, the power driven sanding head of the tool is designed to have first and second passages or sets of passages within its interior, one of which conducts incoming water through the interior of the sanding head to the work surface, and the other of which conducts a suction induced flow of air, water and particles abraded from the work surface through the interior of the head in isolation from the incoming water for delivery to a discharge or collection location. The passage or passages through which the incoming water flows may lead to a first opening or pattern of openings through which the water discharges to the work surface, while a second or different opening or pattern of openings receive the-flow of intermixed air, water and particles for delivery through the interior of the head to a collection point. This flow of air, water and abraded particles may be induced by an aspirator carried by the body of the tool and energized by the pressure of air discharged from an air motor driving the tool. The power driven head of the tool may include a deformable cushion within which the two sets of isolated passages are formed, and a more rigid backing plate connected to the upper side of the deformable cushion and within which openings are formed for delivering water to and discharging intermixed air, water and particles from the internal passages in the head. The head may be driven by an orbital drive connection extending between the motor of the tool and the head, with a boot having a flexible side wall disposed about the orbital drive connection, and with the water being admitted to the head, and the air, particles and water being discharged from the head, at the exterior of that boot.

BRIEF DESCRIPTION OF THE DRAWINGS

The above and other features and objects of the invention will be better understood from the following detailed description of the typical embodiment illustrated in the accompanying/drawings, in which.

DETAILED DESCRIPTION OF THE PREFERRED EMBODIMENT

Figure 1:
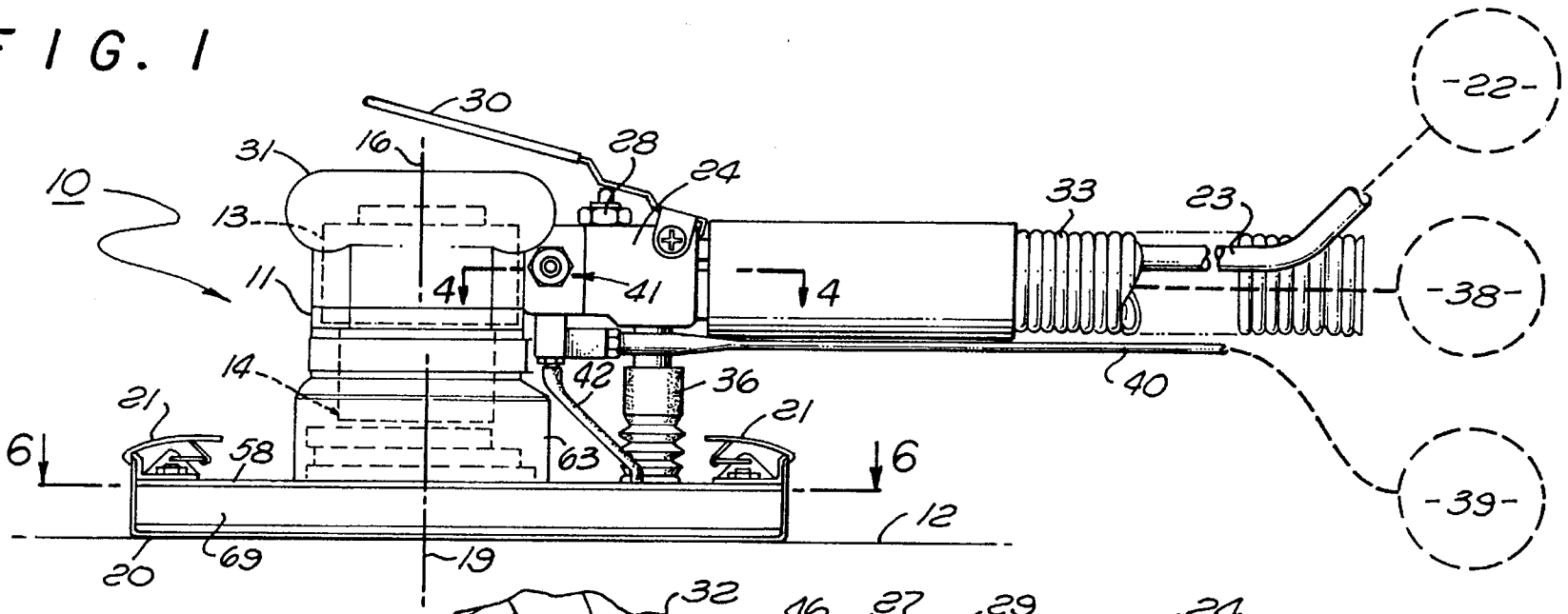
FIG. 1 is a side elevational view of a portable powered sander embodying the invention.

The portable orbital sander 10 shown in the drawings has a body structure 11 shaped externally as a handle to be grasped by a user for holding the tool and moving it along a typically horizontal work surface 12 to sand or polish that surface. An air driven motor 13 contained within the body structure 11 of the tool acts through an orbital drive connection 14 to move a sanding head or pad 15 orbitally about a vertical axis 16 of the motor. The drive connection 14 includes a carrier part **14*a* which is driven rotatively about vertical axis 16 by motor 13, and a part 17 connected by bearings 18 to carrier 16 for rotation relative thereto about a second vertical axis 19 offset slightly from and parallel to axis 16, giving the part 17 its desired orbital movement about the principal axis 16 of the motor. Head 15 is connected to part 17 for orbital movement therewith, and carries adjacent its horizontal undersurface a sheet of sandpaper 20, which may be secured removably to head 15 in any convenient manner, as by clips represented at 21**, or by an adhesive or other conventional means.

Figure 4:
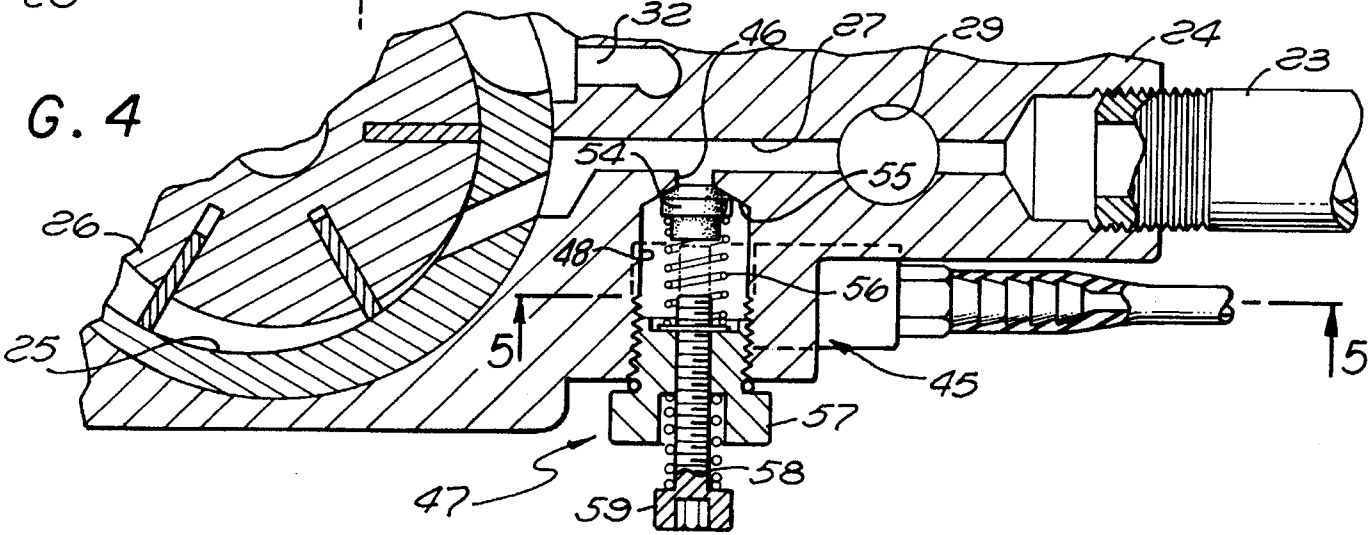
FIG. 4 is a fragmentary generally horizontal section through the feed water valuing mechanism taken on line 4—4 of FIG. 1.

Air is supplied to motor 13 from a source 22 of compressed air through a flexible line 23 connecting into the rear of a main rigid part 24 of the body structure 11 of the tool. The forward portion of this body 24 may serve as the housing or stator of motor 13, containing a vertical cylindrical chamber 25 within which a vaned rotor 26 of the motor is driven rotatively by the compressed air about vertical axis 16. As seen in FIG. 4, air flows from the line 23 to motor chamber 25 through a passage 27 in body 24, with the flow of air being turned on and off by a valve 28 actuable upwardly and downwardly within a vertical cylindrical passage or chamber 29 in body 24 by a manually actuated operating lever 30. A cushion 31 typically of essentially square horizontal cross section may extend about the upper portion of the body structure of the tool to cushion the contact of a user's hand with the tool.

Exhaust air is discharged from motor 13 through a passage 32 formed in the main body part 24 and discharging therefrom into a flexible hose 33 which surrounds the rearwardly projecting portion of body part 24 and part of line 23 thereabove, and is sealed with respect thereto by a gasket or s sealing element 34. The exhaust passage 32 serves as a portion of an aspirator device 35, which utilizes the energy of the rearwardly exhausting air to create a suction effect inducing a flow of air, abraded particles and water from the sanding head 15 through a flexible rubber vertical tube 36 leading to a passage 37 in part 24. The flow of air, particles and water is drawn rightwardly from the end of passage 37 which is directly beneath and closely adjacent passage 32 from which the exhaust air of the motor is emitted. Hose 33 leads the intermixed air, water and abraded particles to a container 38 in which the water and particles are collected. The air supply hose 23 is preferably contained within hose 33 along most of the length of line 23, and may branch off from the hose through its side wall at a location near the air supply source 22 as represented in FIG. 1.

Water is supplied to the tool from a source 39 of such water (FIG. 1) through a small flexible hose or tube 40 which may extend along the outside of hose 33, and which is connected at its forward end as viewed in FIG. 1 to a water supply valuing assembly 41 from which water is delivered through a short generally vertical flexible rubber hose 42 to the orbitally driven head 15 of the tool. The water is fed to the work surface through a first pattern of passages and openings 43 in head 15, and the mixture of intermixed air; water and abraded particles is drawn by aspirator 35 through a second pattern of passages 44 formed in head 15 in isolation from water passages 43.

Figure 5:
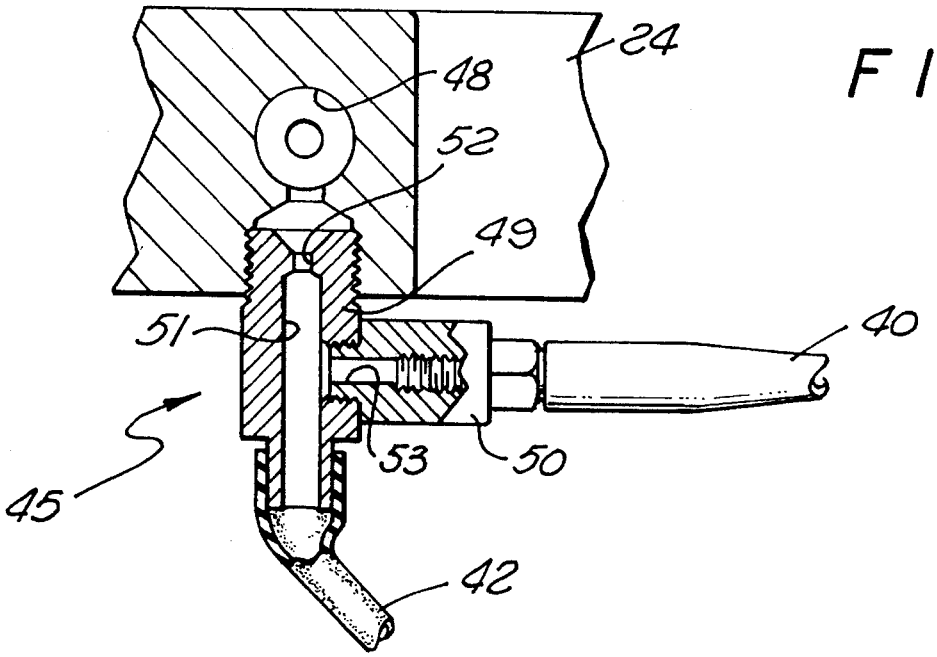
FIG. 5 is a fragmentary vertical section taken primarily on line 5—5 of FIG. 4.

The water supply valuing unit 41 includes a second aspirator 45 which projects downwardly from the underside of portion 24 of the tool body. The flow of water through this aspirator is induced by a flow of air taken from the previously mentioned passage 27 through which the main flow of air to the motor passes. The air flow to the aspirator is taken from passage 27 through a branch passage 46 (FIG. 4) leading past a valve assembly 47 in a chamber 48 to aspirator 45. As seen in FIG. 5, the aspirator includes a block 49 connected threadedly to the underside of portion 24 of the body of the tool, and a second block 50 connected threadedly into a side of block 49. Pressurized air entering aspirator 45 from valve chamber 48 flows downwardly through a vertical passage in block 49 and into flexible tube 42 leading to head 15. The downwardly moving air acts by aspirator action to draw water from inlet line 40 through a passage in block 50 into vertical passage 51 in block 49, to flow downwardly with the air to head 15. A restriction 52 in passage 51 acts to increase the velocity of the downward flow of air at the location of the water inlet passage 53, to enhance the aspirator action.

Referring again to FIG. 4, the branch passage 46 opens horizontally into valve chamber 48 in portion 24 of body 11 of the tool. The valve assembly 47 in chamber 48 includes a check valve element 54 which may be formed of rubber or other resiliently deformable material, and which is yieldingly urged toward a seat 55 in portion 24 of the body to seal off the flow of air or water from chamber 48 back through passage 46 to the main air inlet passage 27 when the tool is turned off. A spring 56 normally urges valve 54 to its closed position, with that spring engaging at its opposite end a part 57 threadedly connected into portion 24 of the body of the tool.

Valve assembly 47 also includes a screw 58 which is threadedly connected to part 57 and is tightenable against valve 54 to lock it in its closed position when desired. The screw is actuable against the check valve by engagement of an appropriate tool with a head 59 of the screw at the exterior of the assembly.

During normal operation of the sander, the inner extremity of screw 58 is spaced axially from valve element 54, and thus does not interfere with movement of the valve element axially away from its seat 55 to allow the flow of pressurized air from passage 27 past valve element 54 into chamber 48. The screw is actuated against check valve 54 to lock it in closed position when it is desired to lubricate motor 13 by introducing lubricant into the flow of air to the motor without bypassing any of that lubricant to aspirator 45 and the sanding head.

The orbitally driven part 17 at the lower end of orbital drive connection 14 may have a lower horizontally extending flange portion 60 which may be circular about the axis 19 of that part. Projecting upwardly from flange 60, part 17 has a shaft portion 61 centered about and extending upwardly along axis 19, and which is journalled within a recess in carrier part **14*a* by the previously mentioned bearings 18, to enable the desired rotation of part 17 relative to part 14*a*. A counterweight 62 may be connected to part 14*a* to balance the eccentricity of part 17 and the other connected parts with respect to the principal axis 16 of motor 13**.

A shroud or boot 63 forms an enclosure about the orbital drive mechanism 14, and may have an essentially tubular generally vertically extending side wall 64 formed of rubber or other resiliently deformable elastomeric material and secured at its upper end by an annular clamp 65 to a lower portion of the handle body 11 of the tool. At the lower end of side wall 64 of boot 63, the boot may have a horizontally extending bottom wall 66 formed of elastomeric material containing a rigid preferably metal reinforcing plate 67 for stiffening the bottom wall of the device and facilitating its connection to the orbitally moving drive element 17.

Figure 6:
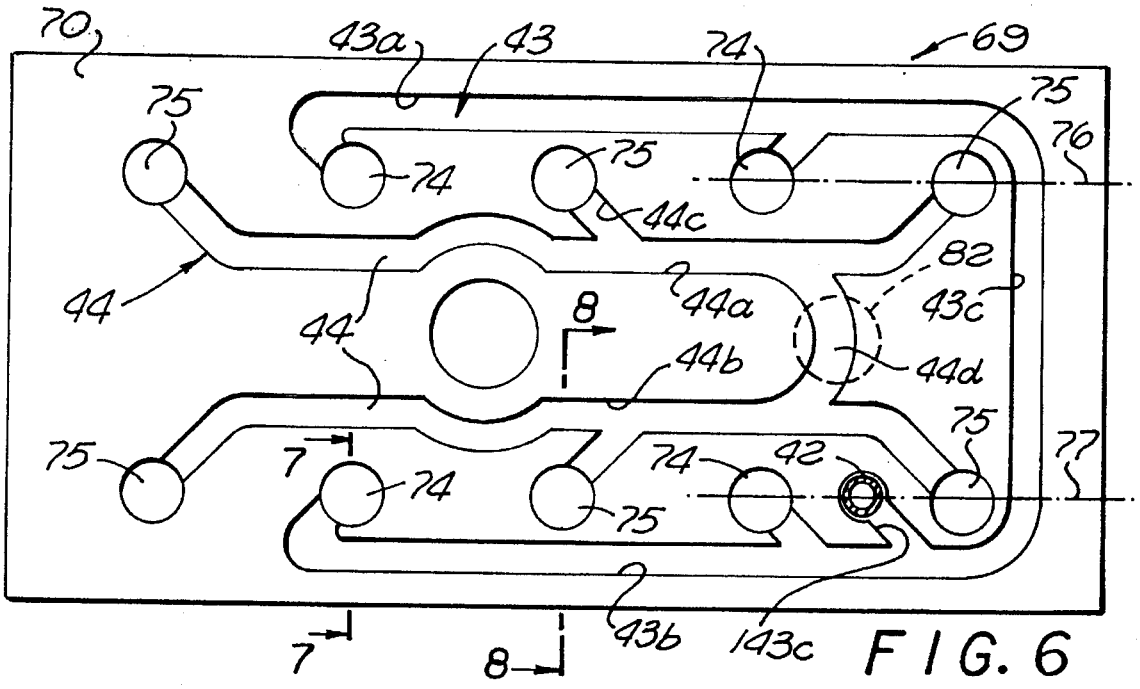
FIG. 6 is a horizontal section taken on line 6—6 of FIG. 1, showing the pattern of water supply passages and suction passages in the orbitally movable pad or head of the tool.
Figure 7:
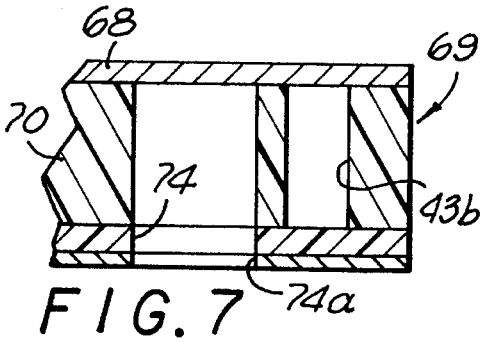
FIGS. 7 and 8 are enlarged fragmentary sections through the head taken on lines 7—7 and 8—8 respectively of FIG. 6.
Figure 8:
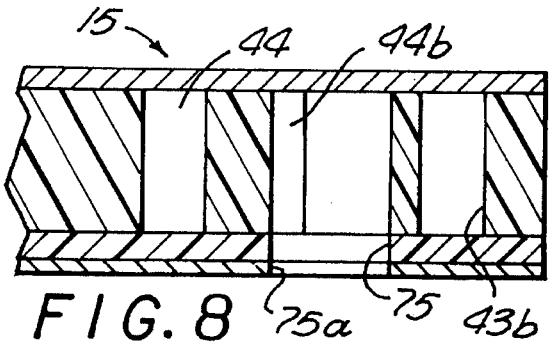
Figure 9:
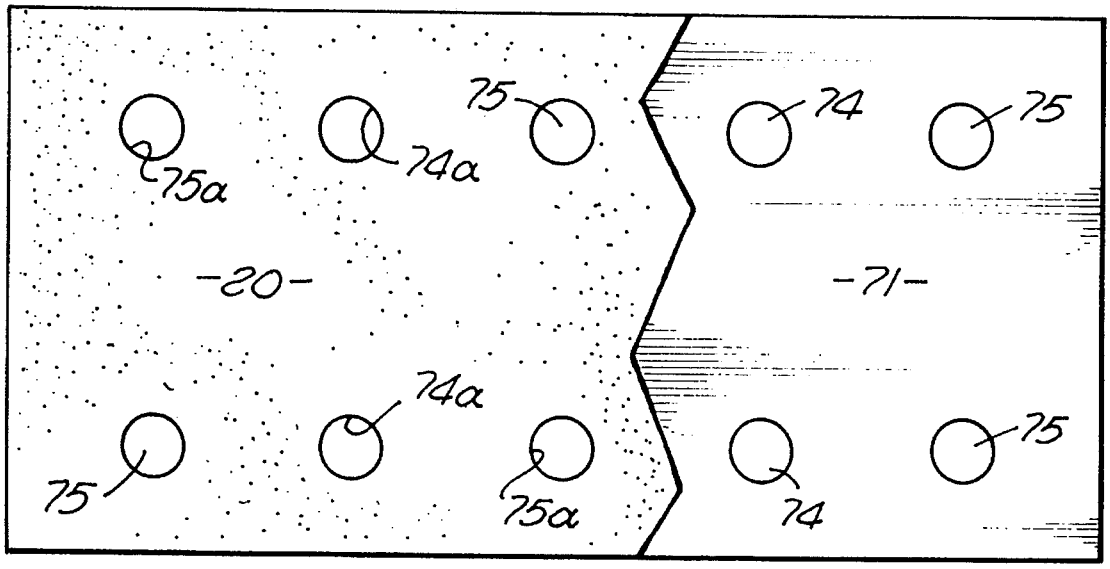
FIG. 9 is a bottom plan view of the abrading head of the tool.

The sanding pad or head 15 is typically of rectangular horizontal section as seen in FIGS. 6 and 9, and includes a rigid preferably metal rectangular backing plate 68. Beneath the backing plate 68, head 15 includes a deformable cushion 69 through which force is applied to the sandpaper sheet 20 in a manner cushioning contact of the sandpaper with the work surface 12. The cushion 69 is preferably formed of two layers of resiliently deformable material, including a relatively thick upper layer 70 and a thinner bottom layer 71, both of which are of the same rectangular horizontal section as top backing plate 68. Layer 70 is desirably made of a resiliently deformable closed pore resinous plastic foam, such as polyurethane form or the like. The upper horizontal surface 72 of foam layer 70 may be bonded to the horizontal undersurface of the more rigid backing plate 68. The bottom layer 71 of cushion 69 is typically formed of a sheet of fabric back vinyl material, tightly and permanently bonded to the horizontal undersurface of layer 70, and has a horizontal undersurface which engages and applies downward force to the sandpaper sheet. The layer or sheet 71 is resiliently deformable with upper layer 70 and the sandpaper sheet, to maintain the sandpaper continuously in contact with the work surface during a sanding operation.

Head 15 is rigidly but detachably secured to the orbitally movable drive element 17 of the tool by a screw or bolt 73, having a shank which is connected threadedly into a threaded bore in part 17 centered about axis 19. The shank of bolt 73 extends through aligned openings in plate 68 and the bottom wall 66 of boot 63, with the enlarged head of bolt 73 being tightenable upwardly against plate 68 to apply upward clamping force thereto and secure it to element 17. Bolt 73 may be insertable upwardly through typically circular openings formed in layers 70 and 71 of cushion 69 and defining a recess within which the head of the bolt is received at a level above that of the sandpaper sheet.

Figure 3:
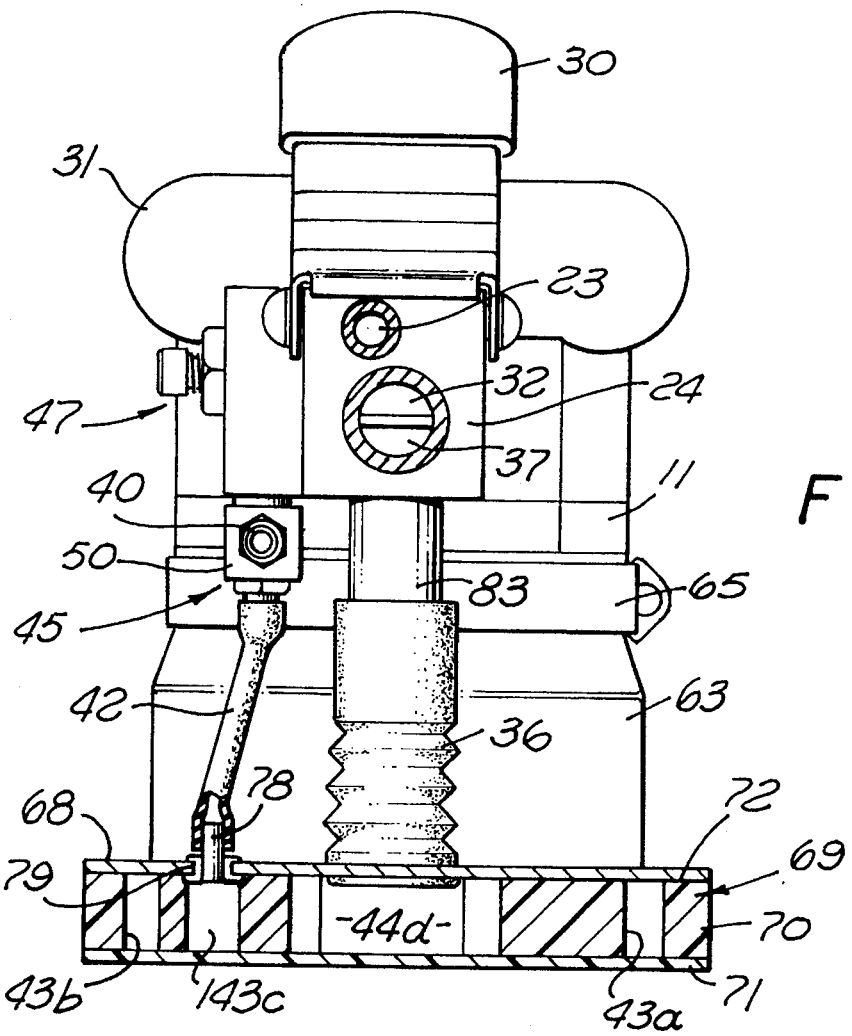
FIG. 3 is an transverse vertical section taken on line 3—3 of FIG. 2.

The passages 43 (FIG. 6) through which water is delivered to the work surface are formed in the upper foam layer 70 of cushion 69, with these passages communicating with a number of openings 74 formed in the bottom layer 71 of the deformable cushion 69 and leading from passages 43 to the underside of head 15. Preferably, there are four of the water delivery openings 74 as seen in FIG. 6, with two of those openings being provided at spaced locations along a front to rear axis 76, and with the second pair being provided at similarly spaced locations along a second front to rear axis 77 parallel to the axis 76. The first two of the openings 74 receive water from a first of the passages 43 (identified as passage 43*a* in FIG. 6)extending parallel to but offset from axis 76. The second pair of openings 74 receive water from a second passage 43b extending parallel to but offset from axis 77. The passages 43*a* and 43*b* communicate with one another through a curving passage 43*c* at one end of the cushion. Passages 43*a*, 43*b* and 43*c* communicate with and receive water from the water delivery tube 42. As seen in FIG. 3, tube 42 may be connected to the upper end of a tubular fitting 78 which is connected into an opening 79 in rigid top plate 68 of head 15, and communicates at its underside with one of the passages 43*a*, 43*b* or 43*c*, typically through a branch passage 143*c* leading into side passage 43*b*. Water can thus flow from tube 42 into the passages 43*a*, 43*b* and 43*c*, leading to the four openings 74 in the bottom of head 15. The sandpaper sheet 20 has openings 74*a* registering with the four openings 74 to deliver the water directly to work surface 12.

In addition to the water delivery passages 43, head 15 contains suction passages 44 isolated from the water supply passages 43 and through which a mixture of air, water and abraded particles is drawn from the work surface. Again referring to FIG. 6, these suction passages 44 are formed in layer 70 of the cushioning material of the head, and receive the intermixed air, water and particles from the undersurface of the pad through a number of openings 75 formed in the bottom layer 71 of head 15. Openings 75 are preferably aligned in a front to rear direction with the two sets of water delivery openings 74, as seen in FIGS. 6 and 9. More particularly, there may be three of the openings 75 aligned with a first of the pairs of water inlet openings 74 along axis 76, and there may be a second group of three of the suction openings 75 aligned with the second pair of water inlet openings 74 along the second front to rear axis 77. In the presently preferred arrangement, one of the openings 75 of each of the groups of three such openings is located between two of the water inlet openings 74, with the other two openings 75 of that group of three being located forwardly of and rearwardly of the corresponding openings 74. As in the case of the water inlet openings, the sandpaper sheet 20 has openings 75*a* registering with and spaced in correspondence with the openings 75 of the head.

Figure 2:
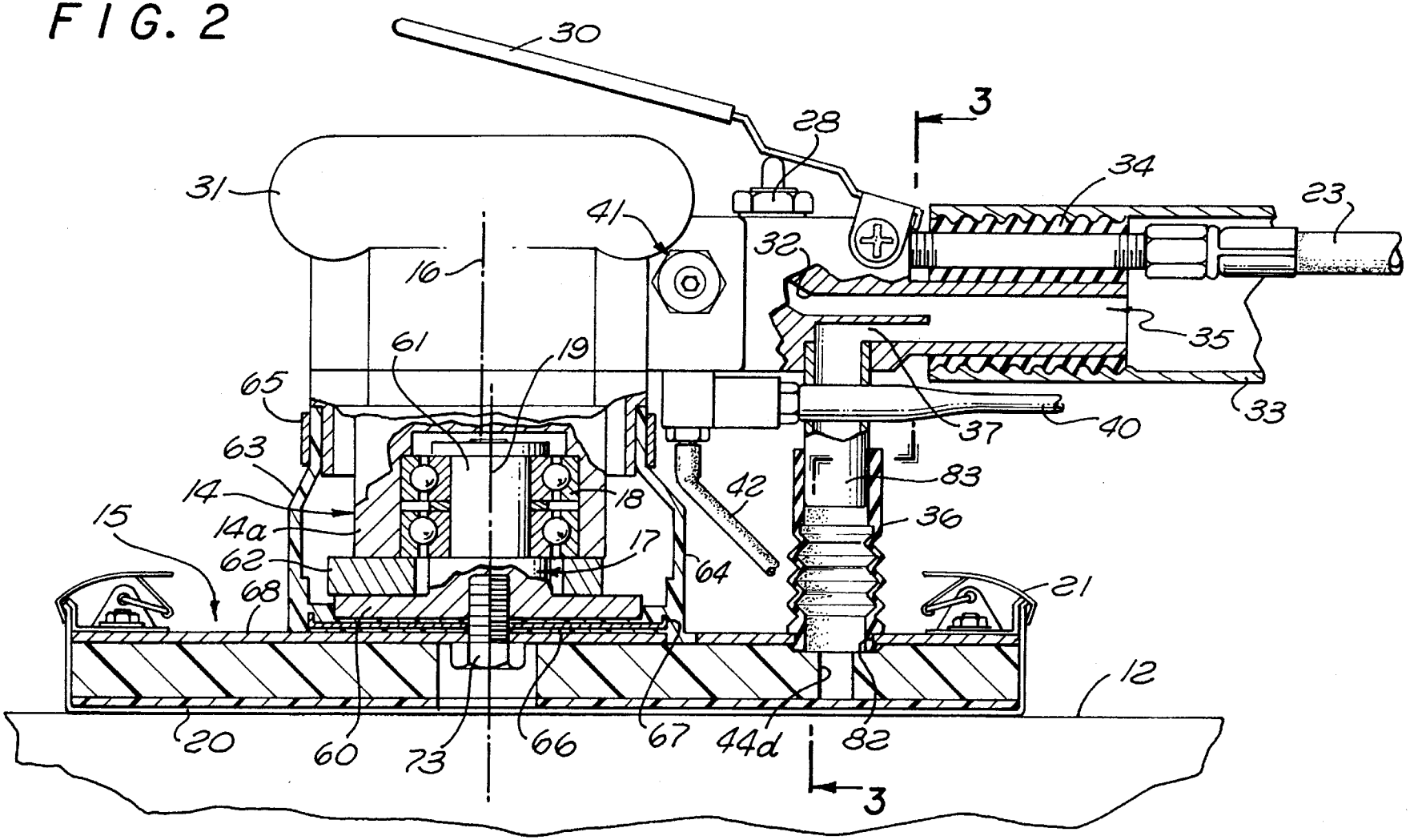
FIG. 2 is an enlarged view of the sander, partially in elevation as in FIG. 1, and partially in vertical section.

The passages 44 in layer 70 of the head communicating with suction openings 75 may include two parallel passages 44*a* and 44*b* extending in a front to rear direction parallel to passages 43*a* and 43*b* and having branch passages 44*c* leading to the various openings 75. The two parallel passages 44*a* and 44*b* may be joined near one end of the head by a curving cross passage 44d which communicates with an opening 82 in plate 68 leading to tube 36 through which a mixture of air, water and particles flows upwardly to aspirator 35. As seen in FIG. 2, the lower end of flexible tube 36 may have a radially outwardly facing peripheral groove for receiving an edge of plate 68 about opening 82, to lock the lower end of the flexible tube 36 in position within opening 82. The upper end of tube 36 may be connected to the aspirator by reception about a rigid tube 83 projecting downwardly from the aspirator. As will be understood, the tube 36 and the water supply tube 42 flex slightly during operation of the tool to permit orbital movement of head 15 relative to the body of the tool.

When the tool is to be utilized for sanding a work surface such as that shown at 12 in FIG. 1, the operator grasps the tool by its cushioned handle portion 31, and presses downwardly on the lever 30 to open valve 28 and emitt pressurized air from inlet line 23 through passage 27 to motor 13, whose operation then acts through orbital drive connection 14 to cause orbital movement of head 15 and the carried sandpaper sheet 20 to abrade the work surface. Some of the air admitted to passage 27 of FIG. 4 flows through branch passage 46 past check valve 54 into chamber 48 of valve assembly 47, and than downwardly through aspirator 45 to draw water from inlet line 40 for delivery downwardly through tube 42 into passages 43 (43*a*, 43*b*, etc.) in head 15. Those passages conduct the water to openings 74 in bottom layer 71 of the head, for delivery through registering openings 74*a* in the sandpaper sheet to the work surface. At the same time, the air discharging from motor 13 acts through aspirator 35 to create a reduced subatmospheric pressure in tube 36 drawing a flow of air, water and abraded particles from the work surface through openings 75*a* in the sandpaper sheet, openings 75 in the bottom layer 71 of head 15, passages 44 (44*a*, 44*b*, etc.) in the upper layer 70 of the head, and opening 82 in the top plate 68 of the head. This stream of air, water and particles flows upwardly through tube 36 and rightwardly from passage 37 of FIG. 2 into hose 33, for delivery by that hose to collection container 38. Because the water supply passages 43 in head 15 do not communicate with suction passages 44 within the head, the incoming water is kept isolated from the suction induced flow of intermixed air, water and abraded particles in passages 44.

While a certain specific embodiment of the present invention has been disclosed as typical, the invention is not limited to this particular form, but rather is applicable broadly to all such variations as fall within the scope of the appended claims.

I claim:

1. A portable abrading tool, comprising:

a tool body to be held and manipulated by a user;

a motor carried by said body;

a head movable relative to said body by said motor and adapted to carry an element for abrading or polishing a work surface;

means for delivering a flow of incoming water to the work surface, including first passage means formed in said head for conducting said water through the interior of the head to the work surface; and additional means for conducting a suction induced flow of intermixed air, water and abraded particles from the work surface, including second passage means formed in the head for conducting said flow of air, water and abraded particles through the interior of the head in isolation from said incoming water and without flow of the intermixed air, water and particles through said first passage means.

2. A portable abrading tool as recited in claim 1, in which said head includes a deformable cushion within which said first passage means and said second passage means are formed in isolation from one another.

3. A portable abrading tool as recited in claim 1, in which said head has a surface adjacent which said element for abrading or polishing the work surface is to be carried, and which contains first openings through which incoming water from said first passage means flows toward the work surface, and second openings through which said flow of intermixed air, water and particles flows into said second passage means in the head.

4. A portable abrading tool as recited in claim 1, in which said head includes a deformable cushion containing said first passage means and said second passage means, and a backing plate more rigid than said deformable cushion.

5. A portable abrading tool as recited in claim 1, in which said head includes a deformable cushion containing said first passage means and said second passage means, and a backing plate more rigid than said deformable cushion; said backing plate containing an inlet opening through which said incoming water flows into said first passage means for delivery therethrough to the work surface, and an outlet opening through which said flow of intermixed air, water and particles flows from said second passage means.

6. A portable abrading tool as recited in claim 1, in which said head has two water discharge openings through which said incoming water flows from said first passage means toward the work surface, and has a third opening essentially between said water discharge openings and through which said flow of intermixed air, water and particles flows from the work surface into said second passage means within the interior of said head.

7. A portable abrading tool as recited in claim 1, in which said head has two openings facing said work surface and through which said flow of intermixed air, water and particles flows from the work surface into said second passage means in the head, and has a third opening essentially between said two first mentioned openings and through which said incoming water flows from said first passage means in the interior of the head toward the work surface.

8. A portable abrading tool as recited in claim 1, in which said head has a series of openings aligned generally in a row and facing toward said work surface, with some of said openings communicating with said first passage means, and others of the openings communicating with said second passage means.

9. A portable abrading tool as recited in claim 1, in which said head has two rows of openings extending generally parallel to one another near opposite side edges of the head and facing toward the work surface, with each of said rows of openings including first openings communicating with said first passage means for delivering incoming water therefrom to the work surface, and second openings through which said intermixed air, water and particles flows into said second passage means in the head.

10. A portable abrading tool as recited in claim 9, in which said first and second openings alternate in each of said rows of openings.

11. A portable abrading tool as recited in claim 1, including a sheet of abrading material serving as said element for abrading or polishing the work surface and containing a first set of openings communicating with said first passage means in said head to pass incoming water from said first passage means to the work surface, and a second set of openings communicating with said second passage means in the head to pass said flow of intermixed air, water and particles from the work surface into said second passage means within the interior of the head.

12. A portable abrading tool as recited in claim 1, in which said head includes a deformable cushion containing said first passage means and said second passage means in isolation from one another and having an essentially flat undersurface adjacent which said element for abrading or polishing a work surface is to be received in the form of a sheet of abrading material, said head including a backing plate more rigid than said deformable cushion and which extends across an upper side thereof and which contains a water inlet opening through which said incoming water enters said first passage means, and an outlet opening through which said flow of air, water and particles flows from said second passage means in the deformable cushion, said essentially flat undersurface of the deformable cushion containing openings communicating with spaced openings in the abrasive sheet for delivering incoming water from said first passage means to the work surface, and said essentially flat undersurface of the deformable cushion containing additional openings communicating with additional spaced openings in the abrasive sheet for passing said flow of intermixed air, water and particles from the work surface to said second passage means in said deformable cushion of the head.

13. A portable abrading tool as recited in claim 12, in which said means for delivering incoming water to the work surface include a flexible conduit be connected to a source of water and connected to said water inlet opening in said backing plate to deliver incoming water thereto.

14. A portable abrading tool as recited in claim 13, in which said additional means include a second conduit extending from said backing plate of the head to said tool body and communicating with said outlet opening in said backing plate to conduct said flow of air, water and particles therefrom.

15. A portable abrading tool as recited in claim 14, in which said motor is an air motor, and including as aspirator carried by said tool body and energized by exhaust air from the motor to induce said flow of air, water and particles from the work surface.

16. A portable abrading tool as recited in claim 15, including an orbital drive mechanism powered by said motor and projecting downwardly toward said head to drive the head orbitally relative to said tool body, and a boot having a flexible essentially tubular side wall extending downwardly between said body and said head and disposed about said orbital drive mechanism, both of said conduits being connected to said backing plate of the head at the exterior of said boot.

17. A portable abrading tool as recited in claim 1, in which said head includes a deformable cushion containing said first passage means and said second passage means in isolation from one another, and a backing plate more rigid than said deformable cushion and which extends across an upper side thereof, there being an orbital drive mechanism powered by said motor and projecting downwardly toward said head for driving the head orbitally relative to said tool body, and a boot having a flexible essentially tubular side wall extending downwardly between said body and said head and disposed about said orbital drive mechanism.

18. A portable abrading tool as recited in claim 17, in which said means for delivering incoming water to the work surface includes an opening in said backing plate at the exterior of said boot through which said incoming water is delivered to said first passage means.

19. A portable abrading tool as recited in claim 17, in which said means for conducting a suction induced flow of intermixed air, water and abraded particles from the work surface include an opening in said backing plate at the exterior of said boot through which said intermixed air, water and abraded particles flow from said second passage means.

20. A portable abrading tool as recited in claim 17, in which said means for delivering incoming water to the work surface include a first opening in said backing plate at the exterior of said boot for delivering water through the backing plate to said first passage means, and said means for conducting a suction induced flow of intermixed air, water and abraded particles from the work surface include a second opening in the backing plate at the exterior of said boot for conducting said air, water and abraded particles from said second passage means.

* * * * *